US008477975B2

(12) United States Patent
Glatt et al.

(10) Patent No.: US 8,477,975 B2
(45) Date of Patent: Jul. 2, 2013

(54) HEARING SYSTEM WITH JOINT TASK SCHEDULING

(75) Inventors: Raoul Glatt, Zurich (CH); Micha Knaus, Jona (CH)

(73) Assignee: Phonak AG, Stafa (CH)

( * ) Notice: Subject to any disclaimer, the term of this patent is extended or adjusted under 35 U.S.C. 154(b) by 401 days.

(21) Appl. No.: 12/808,752

(22) PCT Filed: Dec. 20, 2007

(86) PCT No.: PCT/EP2007/064394

§ 371 (c)(1),
(2), (4) Date: Jun. 17, 2010

(87) PCT Pub. No.: WO2009/080108

PCT Pub. Date: Jul. 2, 2009

(65) Prior Publication Data

US 2010/0266151 A1 Oct. 21, 2010

(51) Int. Cl.
*H04R 24/00* (2006.01)

(52) U.S. Cl.
USPC ..... 381/315; 381/312; 718/102; 718/103

(58) Field of Classification Search
USPC ..... 381/315, 312; 718/102, 103
See application file for complete search history.

(56) References Cited

U.S. PATENT DOCUMENTS 5,848,146 A * 12/1998 Slattery ..... 379/406.01
5,949,891 A * 9/1999 Wagner et al. ..... 381/98
6,021,207 A * 2/2000 Puthuff et al. ..... 381/330
6,181,801 B1 * 1/2001 Puthuff et al. ..... 381/380
6,445,799 B1 * 9/2002 Taenzer et al. ..... 381/71.6
6,665,409 B1 * 12/2003 Rao ..... 381/63
6,898,470 B1 * 5/2005 Rao et al. ..... 700/94
7,844,062 B2 * 11/2010 Bauml et al. ..... 381/312

(Continued)

FOREIGN PATENT DOCUMENTS

EP 1445982 A2 8/2004
EP 1651005 A2 4/2006

(Continued)

OTHER PUBLICATIONS

International Search Report for PCT/EP2007/064394 dated Dec. 5, 2008.

(Continued)

*Primary Examiner* — David S. Warren
(74) *Attorney, Agent, or Firm* — Pearne & Gordon LLP

(57) ABSTRACT

The hearing system (1) comprises a first processing unit (2A); a second processing unit (2B); and a scheduling unit (3) for jointly scheduling tasks to be executed in said first processing unit (2A) and tasks to be executed in said second processing unit (2B). Preferably, the hearing system (1) comprises a first device (1A) comprising said first processing unit (2A); and a second device (1B) comprising said second processing unit (2B).

The method for operating a hearing system (1) comprising a first (2A) and a second (2B) processing unit, comprises the step of jointly scheduling at least one task to be executed in said first processing unit (2A) and at least one task to be executed in said second processing unit (2B). If, during scheduling of a task to be executed in said first processing unit, tasks to be executed in said second processing unit can be considered, an improved performance of the hearing system (1) can be achieved, e.g, an improved time synchronization or an improved handling of obsolete tasks.

15 Claims, 2 Drawing Sheets

U.S. PATENT DOCUMENTS

| | | | | |
|---|---|---|---|---|
| 8,190,189 | B2 * | 5/2012 | Lerke | 455/522 |
| 8,213,652 | B2 * | 7/2012 | Boguslavskij et al. | 381/315 |
| 2002/0131613 | A1 | 9/2002 | Jakob | |
| 2003/0002509 | A1 * | 1/2003 | Vandenhoudt et al. | 370/395.72 |
| 2005/0268300 | A1 * | 12/2005 | Lamb et al. | 718/100 |
| 2005/0278520 | A1 * | 12/2005 | Hirai et al. | 713/1 |
| 2007/0140506 | A1 * | 6/2007 | Roeck et al. | 381/77 |
| 2007/0269049 | A1 * | 11/2007 | Glatt et al. | 381/23.1 |
| 2008/0021987 | A1 * | 1/2008 | Bates et al. | 709/223 |
| 2010/0266151 | A1 * | 10/2010 | Glatt et al. | 381/314 |

FOREIGN PATENT DOCUMENTS

| | | | |
|---|---|---|---|
| EP | 1715723 | A2 | 10/2006 |
| EP | 1746861 | A1 | 1/2007 |
| EP | 1750482 | A2 | 2/2007 |
| WO | 9943185 | A1 | 8/1999 |

OTHER PUBLICATIONS

Written Opinion for PCT/EP2007/064394 dated Dec. 5, 2008.

* cited by examiner

HEARING SYSTEM WITH JOINT TASK SCHEDULING

TECHNICAL FIELD

The invention relates to the field of hearing devices and to hearing systems. It relates to methods and apparatuses according to the opening clauses of the claims.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted.

A hearing system comprises at least one hearing device. In case that a hearing system comprises at least one additional device, all devices of the hearing system are operationally connectable within the hearing system. Typically, said additional devices such as another hearing device, a remote control or a remote microphone, are meant to be worn or carried by said individual.

BACKGROUND OF THE INVENTION

In many modern hearing systems such as binaural hearing systems, two or more devices are wirelessly interconnected. There are several purposes for which it is of interest to synchronize processes such as signal generation or signal processing taking place in different devices of such a hearing system, e.g., in a left and a right hearing device of a binaural hearing system. Several ways to achieve a synchronization of such processes are known:

In EP 1750482, a method for synchronous presentation of signaling beeps in binaural hearing systems is disclosed.

In EP 1624723, a method for increasing the accuracy of a master clock oscillator of a hearing device by exchanging a clock reference from a crystal driven accessory is disclosed.

In EP 1746861, a method of tuning the master clock oscillator of a hearing device by means of a correlation, receiving an external reference signal, is disclosed.

In U.S. 2002/01316131, a binaural hearing system with a communication link is disclosed.

In EP 1715723, a method for establishing a network time and using the network time for the synchronization of events is disclosed.

In EP 1651005, a binaural hearing system and method for time-aligned audio signal perception of sounds generated in the hearing system is disclosed.

A modern digital hearing device usually comprises one or more processors such as a digital signal processor and a controller. Also other devices of a hearing system, such as for example a remote control, can comprise one or more processors. In such hearing devices, it is common to have one scheduler for each of those processors, which schedules—on the lowest scheduling level and therefore as the final authority—the tasks which are to be executed in the corresponding processor. Such a scheduler is realized in the corresponding device in form of software and/or hardware.

SUMMARY OF THE INVENTION

One object of the invention is to create a hearing system having an improved performance. In addition, the respective method for operating a hearing system shall be provided, as well the respective use of a scheduling unit in a hearing system.

Another object of the invention is to create a hearing system having an improved behavior.

Another object of the invention is to provide a possibility to realize an improved time synchronization between tasks carried out in different processing units of a hearing system, and in particular between tasks carried out in different devices of a hearing system.

Another object of the invention is to realize a hearing system which is operable in a particularly consistent way.

Another object of the invention is to realize a hearing system which is particularly well-reacting.

Another object of the invention is to realize a hearing system having an improved task handling.

Further objects emerge from the description and embodiments below.

At least one of these objects is at least partially achieved by apparatuses and methods according to the patent claims.

The hearing system comprises

- a first processing unit;
- a second processing unit;
- a scheduling unit for jointly scheduling tasks to be executed in said first processing unit and tasks to be executed in said second processing unit.

The method for operating a hearing system comprising a first and a second processing unit comprises the step of jointly scheduling at least one task to be executed in said first processing unit and at least one task to be executed in said second processing unit.

The use according to the invention is a use of a scheduling unit in a hearing system comprising a first processing unit and a second processing unit, for jointly scheduling tasks to be executed in said first processing unit and tasks to be executed in said second processing unit.

Through this, an improved performance of the hearing system can be achieved. It is, in particular, possible to reschedule tasks still at a very late point in time. It is possible to consider interdependencies between different devices of the hearing system and/or between tasks being executed or to be executed in said first and in said second processing unit, respectively, still at a very late stage.

Said scheduling unit is generally a task scheduling unit.

Said task is generally a processing task, i.e. instructions to a processor describing when to carry out which processing steps. "Tasks" as they are mentioned here largely correspond to what is referred to as a "process" or what is referred to as a "thread" in the field of computing.

Said processing unit can be, e.g., a CPU (central processing unit), a DSP (digital signal processor), a micro-controller or some other processing hardware.

Said jointly scheduling of said tasks can—at least from a particular point of view—also be referred to as a scheduling of tasks for said first processing unit and of tasks for said second processing unit in a combined fashion.

Viewed from another particular point of view, said jointly scheduling of said tasks means that during scheduling (or at the time of scheduling) of a task to be executed in said first processing unit, tasks to be executed in said second processing unit and possibly also tasks currently executed said second processing unit can be considered, and typically vice versa. The scheduling unit has access to corresponding data and is therefore "aware" of tasks to be executed and typically also currently exectued in said second processing unit (pending tasks and ongoing tasks for the second processing unit). Of course, also pending tasks and ongoing tasks for the first processing unit will usually be considered during scheduling (or at the time of scheduling) of a task to be executed in said first processing unit.

Viewed from another particular point of view, said jointly scheduling of said tasks means that the scheduling of a task to be executed in said first processing unit is dependent on tasks to be executed in said second processing unit and possibly also on tasks currently executed said second processing unit, and typically vice versa.

Viewed from a different angle, according to the invention, the hearing system comprises a storage unit comprising data representative of a task schedule comprising at least one task scheduled for execution in said first processing unit and at least one task scheduled for execution in said second processing unit.

Said scheduling unit can be realized in form of software or in form of hardware or in form of a combination of software and hardware. Said software can run on a processor, e.g., said first and/or said second processor; said hardware can be or comprise an EEPROM, an ASIC, an FPGA or others.

It is possible to provide that said scheduling unit schedules tasks for all processing units of said hearing system. But it is also possible to provide that there are one or more processing units in said hearing system for which tasks are not scheduled by said scheduling unit.

Note that the term "scheduling" as used in this application does not mean providing a schedule to one or more individuals concerning tasks the individual(s) has/have to carry out, such as it is done in electronic agendas, personal organizers and the like.

From the online encyclopedia Wikipedia, the following definition concerning scheduling in the field of computer science has been derived:

> "In computer science, a scheduling algorithm is the method by which threads or processes are given access to system resources, usually processor time."

(http://en.wikipedia.org/wiki/Scheduling_algorithm)

In a certain view, the term "scheduling" as used in this application approximately corresponds to this Wikipedia understanding of "scheduling" in computer science.

In one embodiment, the hearing system comprises a first device comprising said first processing unit;

a second device comprising said second processing unit.

Typically, said first and second devices are wirelessly interconnectable or wirelessly interconnected.

In one embodiment, the hearing system comprises a storage unit comprising data representative of a task schedule comprising at least one task scheduled for execution in said first processing unit and at least one task scheduled for execution in said second processing unit. Of course, it is possible to provide that, when there are currently no pending tasks, the storage unit can be empty. Said task schedule or, more precisely, said data, are the result of said joint scheduling and are generated by said scheduling unit, respectively. Said task schedule can in particular be considered a joint or common or combined task schedule for said first and said second processing unit. Said task schedule typically is a list of tasks each having assigned a priority, e.g., a scheduled time of execution or a scheduled time by when the task is to be completed (due date).

In one embodiment, said at least one task scheduled for execution in said first processing unit and said at least one task scheduled for execution in said second processing unit are each provided with a priority indicator.

In particular, said priority indicator may comprise a scheduled time of execution for the corresponding task. It is possible to provide that said scheduled time of execution means "as soon as possible".

Furthermore, it is possible to provide tasks in said task schedule with an indicator indicative of the processing unit in which the task is to be executed and/or with an indicator indicative of that one device which has requested the execution of the corresponding task. The latter can be helpful, e.g., if a requested task has to be scheduled for execution at a particularly late point in time, because it allows to easily provide the requesting device with information stating the delay. The requesting device can thereupon, e.g., inform the user of the hearing system about the delay, in particular if the user had demanded (directly or indirectly) the execution of the respective task.

Furthermore, it is possible to provide tasks in said task schedule with an indicator indicative of the point in time at which the respective task has been requested. This can be very helpful during scheduling, because from this time of request, an order (sequence) of requests can be obtained which can be helpful when assigning priorities to tasks or when rescheduling tasks.

In one embodiment, said storage unit is comprised in at least one device of said hearing system, and a copy of said data representative of said task schedule is stored in at least one other device of said hearing system. In other words, at least two copies of said data exist, which provides some redundancy. This makes the operation of the hearing system safer, in particular if it is to be expected that interconnections between devices of the hearing system are occasionally interrupted.

In one embodiment, said storage unit is distributed among at least two devices of said hearing system. This can be accomplished, e.g., in a time-division-multiplexed fashion.

For example, it is possible to provide that the device which most recently requested the execution of a task will carry out the next step(s) of said joint scheduling. This can be advantageous in terms of stability of the hearing system operation when it is to be expected that interconnections between devices of the hearing system are occasionally interrupted (temporarily lost communication connection). Alternatively, it is of course possible to provide that said storage unit is comprised in one device ("master device") of the hearing system, and said data representative of said task schedule are, during operation of the hearing system, stored therein.

In one embodiment, said scheduling unit is distributed among at least two devices of said hearing system. This can be accomplished in a time-division-multiplexed fashion, e.g., such that in that device, which most recently requested the execution of a task, said joint scheduling will be carried out. Or, it can be accomplished, e.g., by parallel processing distributed in different devices of the hearing system. Alternatively, it is of course possible to provide that said scheduling unit is comprised in one device ("master device") of the hearing system.

In one embodiment of the method, said first and said second processing units are each comprised in a different device of said hearing system, and said method comprises the step of operationally interconnecting said two different devices in a wireless fashion.

In one embodiment, the method comprises the step of generating data representative of a task schedule comprising at least one task scheduled for execution in said first processing unit and at least one task scheduled for execution in said second processing unit.

In one embodiment, the method comprises the step of providing each of said at least one task scheduled for execution in said first processing unit; and said at least one task scheduled for execution in said second processing unit with a priority indicator.

In one embodiment, the method comprises the step of storing said data in a distributed fashion in at least two devices of said hearing system.

In one embodiment, the method comprises the step of carrying out said jointly scheduling in a distributed fashion in at least two devices of said hearing system.

Viewed from another different angle, a hearing system according to the invention comprises a scheduling unit adapted to scheduling tasks for at least a first processing unit of the hearing system, wherein said scheduling unit has access to tasks requested for execution in said first processing unit and to tasks requested for execution in a second processing unit of the hearing system. Typically, said scheduling unit schedules tasks for at least said first and said second processing units of the hearing system and has access to data representative of tasks requested for execution in said first processing unit and to data representative of tasks requested for execution in said second processing unit.

The invention comprises methods and uses with features of corresponding hearing systems according to the invention, and vice versa.

The advantages of the methods and uses correspond to the advantages of corresponding apparatuses and vice versa.

Further embodiments and advantages emerge from the dependent claims and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. The described embodiments are meant as examples and shall not confine the invention.

DETAILED DESCRIPTION OF THE INVENTION

Figure 1:
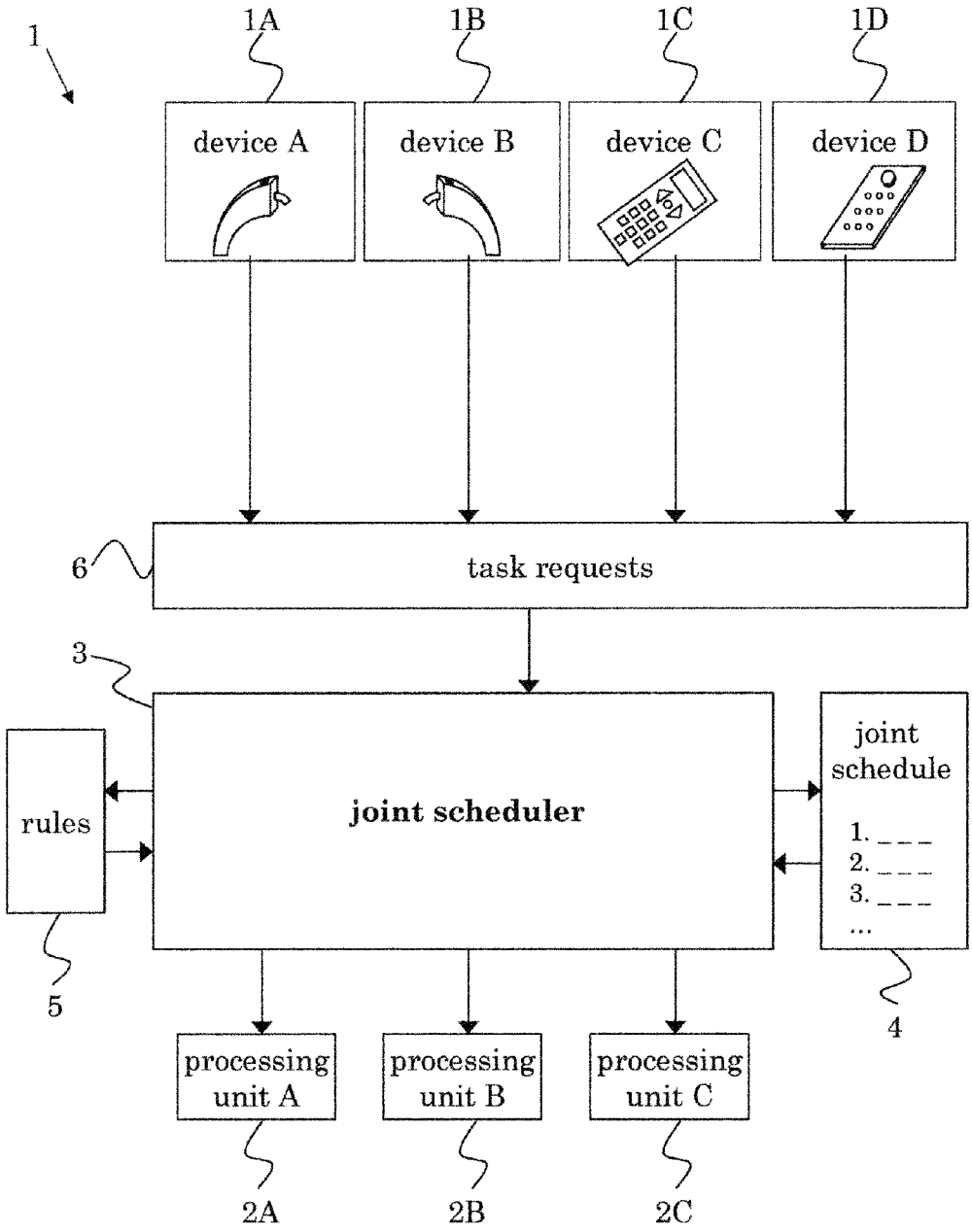
FIG. 1 a block-diagrammatical illustration of a hearing system and a method according to the invention.

FIG. 1 shows schematically a block-diagrammatical illustration of a hearing system 1 and a method according to the invention. The hearing system 1 comprises devices 1A, 1B, 1C, 1D, e.g., a left hearing device 1A, a right hearing device 1B, a comprehensive remote control 1C and a simple remote control 1D. The other components of the hearing system 1 shown in FIG. 1 are realized in one or more of the devices 1A, 1B, 1C, 1D. Further details and components of the hearing system 1 are not shown in FIG. 1.

Any of the devices 1A, 1B, 1C, 1D can request the execution of tasks to be executed in one or more processing units 2A, 2B, 2C of the hearing system 1. It shall be assumed that processing unit 2A, e.g., a digital signal processor, is comprised in device 1A, processing unit 2B, e.g., a digital signal processor, is comprised in device 1B, and processing unit 2C, e.g., a controller, is comprised in device 1C, whereas device 1D has no processing unit or has at least no such processing unit of which another device (besides device 1D itself) could request that a task should be executed in it. It is also possible that there are two or more processing units comprised in one or more of the devices 1A, 1B, 1C, 1D.

A task request is typically generated by a device 1A, 1B, 1C, 1D itself or upon a user action. E.g., a classifier in device A could detect that the current acoustic environment has changed and request thereupon the execution of a program change into a corresponding hearing program. Such a program change would have to be carried out by hearing devices 1A, 1B and, more particularly, by processing units 2A and 2B. Another example: The hearing system user toggles a volume switch of device 1D or of hearing device 1A for increasing the output volume of both hearing devices 1A, 1B. That task should then be executed by processing units 2A and 2B. When the execution of a task is requested, it is possible that also the device or processor in which the task is to be executed, is specified, but it is also possible that this will be determined at a later stage, namely during scheduling.

Any task request will be collected (stored) in a storage unit 6. It would also be possible to provide that only a certain kind of tasks, e.g., tasks requested by certain devices or tasks requested for execution in certain devices, are stored in storage unit 6.

From storage unit 6, the requested tasks are fed to a scheduling unit 3, also referred to as joint scheduler 3. Accordingly, joint scheduler 3 is provided with information about all requested tasks, regardless of the processing unit in which the task shall be executed. This makes it possible to provide that joint scheduler 3 generates a joint schedule, i.e. a schedule comprising scheduled tasks for execution in any of the processing units 2A, 2B, 2C. Such a joint schedule (or, more precisely, data representative thereof) are stored in a storage unit 4. And, during the scheduling, joint scheduler 3 can consider interdependencies between tasks requested for execution in any of the processing units 2A, 2B, 2C. Accordingly, by means of a hearing system 1 as shown in FIG. 1, it is possible to perform scheduling of tasks to be executed in one processing unit in dependence of tasks requested for execution in one or more other processing units. Accordingly, e.g., corrections can be made still at a very late stage, namely still during scheduling and immediately before task execution. Scheduling unit 3 is adapted to jointly scheduling.

Note that—in contrast thereto—in the state of the art in hearing systems, a scheduler only schedules tasks for one single processing unit and is not "aware" of tasks requested for execution in other processing units. Such a scheduler cannot consider tasks requested for execution in other processing units during scheduling. In case that there is some correlation between a task to be executed in a first processing unit and a task to be executed in a second processing unit, e.g., both tasks shall be executed at approximately the same time, information about this correlation is used before the (separate) schedulers for the first and second processing unit, respectively, are provided with the requested tasks, and said information is neither known to the schedulers, nor used during the separate scheduling processes.

For properly accomplishing the scheduling, joint scheduler 3 has access to storage unit 5 in which rules are stored. Such rules determine or at least influence the behavior of the hearing system 1. For example, the rules can determine, which kind of tasks shall be treated as more important than others.

Said joint schedule can, e.g., be one list comprising the scheduled tasks for execution in whichever processing unit, or be composed of a separate list of scheduled tasks for execution in each of the processing units.

Typically, when a task has been scheduled (and is comprised in said joint schedule), it has been provided with a priority with respect to when it will be executed. A corresponding priority indicator can, e.g., indicate a position in a queue, or indicate a point in time at which the task is scheduled to be executed.

According to the data in the joint schedule, the scheduled tasks will be executed, each one in the processing unit for which it is scheduled.

After scheduling or after execution of a task, the task request can be deleted from storage unit 6.

The joint schedule is, of course, steadily (more or less continuously) being updated or renewed, always considering new requested tasks.

It is possible to realize the components 3, 4, 5, 6 of hearing system 1 according to the invention in various ways, in software, in hardware, in combinations of software and hardware. For the distribution of components 3, 4, 5, 6 among the devices 1A, 1B, 1C, 1D, there are various possible ways. For example, it is possible to choose one "master device", e.g., device 1C, which then comprises components 3, 4, 5, 6.

Figure 2:
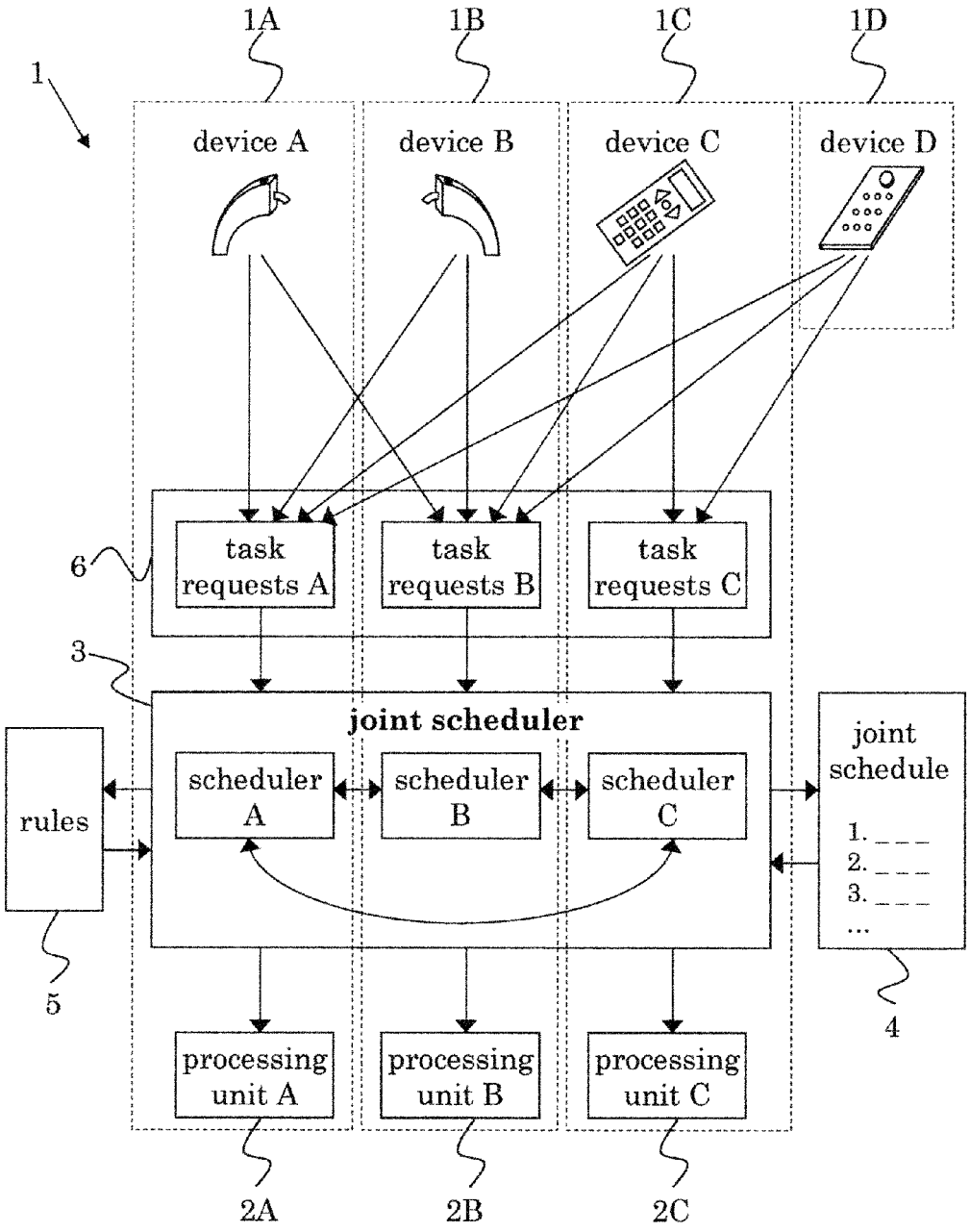
FIG. 2 a block-diagrammatical illustration of a hearing system and a method according to the invention.

FIG. 2 shows a block-diagrammatical illustration of a hearing system 1 and a method according to the invention similar to FIG. 1. Using FIG. 2, further possible distributions of joint scheduler 3 and storage units 4, 5, and 6 among devices 1A, 1B, 1C, 1D will be discussed.

As indicated by the three boxes inside the storage unit 6 labeled task requests A, B, and C, respectively, storage unit 6 can be distributed among several devices of the hearing system 1, e.g., as shown, among devices 1A, 1B, 1C.

It is possible to accomplish this in a time-division-multiplexed way, so that—at any time—all current task requests are stored within one of the devices 1A, 1B, 1C.

It is also possible to provide, that storage of task requests takes place simultaneously in all the devices 1A, 1B, 1C and to collect all task requests—as fast as possible—in all the devices 1A, 1B, 1C, 1D. In this case, the scheduling unit 3 will typically have to sort out superfluous multiply-occurring task requests.

Whatsoever, scheduling unit 3 should receive all requested tasks.

As indicated by the three boxes inside scheduling unit 3 labeled scheduler A, B, and C, respectively, scheduling unit 3 can be distributed among several devices of the hearing system 1. This can be accomplished by, e.g., time-division multiplexing. It is possible to provide that that one device which most recently requested a task will accomplish the joint scheduling and, accordingly, update the joint schedule in storage unit 4.

Storage unit 4 comprising the joint schedule can also be distributed among several devices of the hearing system 1, e.g., in a time-division-multiplexed way, preferably along with the joint scheduler 3. The same applies to storage unit 5 comprising the rules.

The invention can have advantages with respect to several aspects, some of which will be discussed below:

1) Re-scheduling of tasks:

There may be situations, in which a requested task becomes out of date, i.e. obsolete. E.g., the hearing system user wants to change from automatic program mode into manual program mode. In response to a corresponding manipulation of a user control of a device of the hearing system, the scheduling unit will schedule a program change task ($tsk_p$), e.g., for execution at time $t_p$. However, it can happen that just shortly before time $t_p$, one device of the hearing system requests the execution of another task ($tsk_h$) which shall overrule the program change task ($tsk_p$), i.e. program change task ($tsk_p$) is out of date and invalid.

A joint scheduling mechanism now can remove program change task ($tsk_p$) on all respective devices of the hearing system and schedule, also on all respective devices, task $tsk_h$, e.g., for execution at a time $t_h$.

2) Avoiding data jam in wireless hearing systems

During the operation of a hearing system comprising three or more devices interconnected via a wireless network, one device may request the transmission of a considerable amount of data from each of the other devices of the hearing system via the network. It shall be assumed that the response of the devices to the request is not time critical, e.g., does not have to occur within, e.g., the next 500 ms.

If the above is carried out without a joint scheduling mechanism, it is likely that a tremendous burst of data will be generated in the network, since in all the devices reacting to the request, the response to the request is likely to be scheduled for execution at approximately the same time.

In order to prevent such data transmission bursts in the network, a joint scheduling mechanism can schedule such tasks generating a large flow of data in the network for execution one after the other, i.e. distributed over time.

This way, the data load in the network is spread over time, and a low the peak load in the network is achieved.

3) Time synchronous data logging in several devices

Data logging is a concept known in the art of hearing devices. Data logging can be used in a hearing system for capturing snapshots of the operating state of all devices of the hearing system. Such snapshots may be used, e.g., by the hearing device fitter or by an automated application in the process of fine-tuning the hearing devices of the hearing system. However, such snapshots are most useful if they are captured at rather precisely the same time in all devices of the hearing system. Thus, data logging should be carried out in a time-synchronized way.

A joint scheduling mechanism can greatly facilitate a time synchronization of tasks such as data logging tasks in multiple devices in a hearing system.

List of Reference Symbols

1 hearing system
1A,1B, . . . device
2A,2B, . . . processing unit, CPU, DSP, controller, processor, processing chip
3 scheduling unit, joint scheduler
4 storage unit
5 storage unit
6 storage unit

What is claimed is:

1. Hearing system, comprising
a first processing unit;
a second processing unit;
a scheduling unit for jointly scheduling tasks to be executed in said first processing unit and tasks to be executed in said second processing unit; and
a storage unit comprising data representative of a task schedule comprising at least one task scheduled for execution in said first processing unit and at least one task scheduled for execution in said second processing unit.

2. The hearing system according to claim 1, comprising
a first device comprising said first processing unit;
a second device comprising said second processing unit.

3. The hearing system according to claim 1, wherein said at least one task scheduled for execution in said first processing unit and said at least one task scheduled for execution in said second processing unit are each provided with a priority indicator.

4. The hearing system according to claim 3, wherein said priority indicator comprises a scheduled time of execution for the corresponding task.

5. The hearing system according to claim 1, wherein said storage unit is comprised in at least one device of said hearing system, and a copy of said data representative of said task schedule is stored in at least one other device of said hearing system.

6. The hearing system according to claim 1, wherein said storage unit is distributed among at least two devices of said hearing system.

7. The device according to claim 2, wherein said scheduling unit is distributed among at least two devices of said hearing system.

8. The device according to claim 2, wherein said jointly scheduling tasks to be executed in said first processing unit and tasks to be executed in said second processing unit is or comprises scheduling tasks for execution in said first processing unit in dependence of tasks requested for execution in said second processing unit.

9. Method for operating a hearing system comprising a first and a second processing unit, said method comprising the step of jointly scheduling at least one task to be executed in said first processing unit and at least one task to be executed in said second processing unit and the step of generating data representative of a task schedule comprising at least one task scheduled for execution in said first processing unit and at least one task scheduled for execution in said second processing unit.

10. Method according to claim 9, wherein said first and said second processing units are each comprised in a different device of said hearing system, said method comprising the step of operationally interconnecting said two different devices in a wireless fashion.

11. Method according to claim 9, comprising the step of providing each of said at least one task scheduled for execution in said first processing unit; and said at least one task scheduled for execution in said second processing unit with a priority indicator.

12. Method according to claims 9, comprising the step of storing said data in a distributed fashion in at least two devices of said hearing system.

13. Method according to claim 9, comprising the step of carrying out said jointly scheduling in a distributed fashion in at least two devices of said hearing system.

14. Method according to claim 9, wherein said step of jointly scheduling at least one task to be executed in said first processing unit and at least one task to be executed in said second processing unit is or comprises scheduling at least one task for execution in said first processing unit in dependence of at least one task requested for execution in said second processing unit.

15. Use of a scheduling unit in a hearing system comprising a first processing unit and a second processing unit, for jointly scheduling tasks to be executed in said first processing unit and tasks to be executed in said second processing unit.

* * * * *